US007040412B2

(12) United States Patent
DeBerry

(10) Patent No.: US 7,040,412 B2
(45) Date of Patent: May 9, 2006

(54) ADJUSTABLE HANGER SYSTEM AND METHOD

(75) Inventor: Blake T. DeBerry, Singapore (SG)

(73) Assignee: Dril-Quip, Inc., Houston, TX (US)

( * ) Notice: Subject to any disclaimer, the term of this patent is extended or adjusted under 35 U.S.C. 154(b) by 3 days.

(21) Appl. No.: 10/261,053

(22) Filed: Sep. 30, 2002

(65) Prior Publication Data

US 2004/0188087 A1 Sep. 30, 2004

(51) Int. Cl.
*E21B 19/00* (2006.01)
*E21B 23/00* (2006.01)

(52) U.S. Cl. ..... 166/382; 166/75.14; 166/368

(58) Field of Classification Search ..... 166/381, 166/382, 75.11, 85.4, 88.1, 88.2, 88.3, 88.4, 166/75.14, 75.13, 206, 208, 368
See application file for complete search history.

(56) References Cited

U.S. PATENT DOCUMENTS 3,468,559 A * 9/1969 Ahlstone ..... 285/18
3,543,847 A * 12/1970 Haeber ..... 166/348
4,019,579 A * 4/1977 Thuse ..... 166/123
4,460,042 A * 7/1984 Galle, Jr. ..... 166/217
4,540,053 A * 9/1985 Baugh et al. ..... 166/348
4,550,782 A * 11/1985 Lawson ..... 166/382
4,691,780 A * 9/1987 Galle et al. ..... 166/348
4,757,860 A * 7/1988 Reimert ..... 166/208
4,836,579 A * 6/1989 Wester et al. ..... 285/3
4,886,121 A * 12/1989 Demny et al. ..... 166/382
4,903,776 A * 2/1990 Nobileau et al. ..... 166/382
4,928,769 A * 5/1990 Milberger et al. ..... 166/382
4,995,464 A 2/1991 Watkins et al.
5,020,593 A * 6/1991 Milberger ..... 166/208
5,076,356 A * 12/1991 Reimert ..... 166/115
5,082,060 A 1/1992 Johnson et al.
5,226,493 A 7/1993 Watkins et al.
5,255,746 A * 10/1993 Bridges ..... 166/348
5,524,710 A 6/1996 Shinn
5,671,812 A 9/1997 Bridges
6,234,252 B1 5/2001 Pallini, Jr. et al.

FOREIGN PATENT DOCUMENTS

GB 2 270 531 A 3/1994
GB 2 356 208 3/2000
WO WO 02/075098 A2 9/2002

* cited by examiner

*Primary Examiner*—Jennifer H Gay
(74) *Attorney, Agent, or Firm*—Browning Bushman P.C.

(57) ABSTRACT

An adjustable hanger system and related method connect a hanger to a wellhead, with a hanger supporting a tubular secured at its lower end in the well. The wellhead includes a housing 20 having a plurality of axially spaced support grooves 23, and a hanger 30 including a support ring 32 radially moveable into a selected one of the support grooves on the wellhead housing. A lock down ring 34 may limit axially upward movement of the hanger with respect to the wellhead, while a support ring 32 may be used to limit axially downward movement of the hanger with respect to the wellhead housing. Both the support ring and the lock ring may be a substantially C-shaped rings which move radially outward into a selected one of the support grooves or locking grooves.

42 Claims, 7 Drawing Sheets

ADJUSTABLE HANGER SYSTEM AND METHOD

FIELD OF THE INVENTION

This invention relates generally to a wellhead and method for use in the drilling and completion of subsea wells and, more particularly, to improvements in a wellhead wherein a tubular, such as a well casing or a liner, may be connected at its lower end to a mud line hanger, with the casing extending into the drilled borehole, wherein the casing is tied back to a hanger adjustably supported within the surface wellhead.

BACKGROUND OF THE INVENTION

In conventional surface wellheads, the surface casing hanger has a shoulder adapted to be landed on a seat in the bore of the surface wellhead, and is then sealed to close the annulus about casing string. For shallow wells, many casing strings are not tensioned, and the casing hanger is simply hung off this shoulder. To provide the desired length of the casing relative to the shoulder, an adjustment mechanism may be provided which allows for adjusting axially several inches the spacing between the engaging surface on the hanger and the shoulder on the wellhead for space-out.

As long as the depth of the water is not too great, the desired space-out of the casing hanger and the wellhead shoulder may be predicted with reasonable accuracy. However, as wells are drilled to considerably greater depths, the operator is faced with the problem of applying too little tension to the casing string once the hanger and thus the casing supported on the hanger is landed on the casing shoulder within the wellhead.

As a related problem, the operator preferably desires a certain tension on the casing once hung off from the shoulder on the wellhead. As water depths increase, it becomes more difficult to calculate the correct space-out, and even if properly calculated, that space-out requires for a deep well a long adjustment mechanism in the casing hanger for engagement with the shoulder. When the casing is hung off and the adjustment member is "fully stroked, " the operator still may not have the desired tension in the casing hanger. Since the adjustment mechanism cannot pass below the shoulder on the wellhead, the operator is forced to either (a) accept the limited tension in the casing that is obtained, or (b) provide a different space-out along the length of the casing, or (c) select a wellhead and an adjustment mechanism for the casing hanger which allows for an even longer stroke length.

In systems where vertical adjustment of the casing relative to the wellhead are made, extremely long wellheads or hanger systems are required to accept the length of adjustment. Systems of this design result in substantially increased stack up height, which then requires more space between deck levels on offshore facilities.

Providing a plurality of vertically spaced seats of varying diameters on which the casing hanger shoulder may be landed, depending on the desired casing stretch, is not a satisfactory solution. Varying diameter seats would increase the radius of the bore through the wellhead housing in which the hanger is landed, thus increasing the I.D. of the wellhead equipment thereabove, which would greatly add to the expense of overall equipment. Also, seals would then have to be provided for sealing with varying diameter bores in the wellhead, and hangers with different diameter shoulders would have to be kept in inventory for landing on the different sized seats.

Some prior art systems contain a seal between two tubular members, so that the seal slides for the length of the desired adjustment. Split latch rings or threads may be used to mechanically interconnect the two tubular members. This sliding seal provides a substantial leak path in the casing hanger system, and the latch rings or threads reduce fatigue life due to dynamic loading.

The disadvantage of the prior art is overcome by the present invention, in an improved wellhead for supporting a hanger is hereinafter disclosed, wherein the tubular, such as casing or liner, supported on the wellhead may be selectively positioned with respect to the wellhead so that the operator may apply a proper tension to the string. An improved wellhead and hanger system accordingly is hereinafter disclosed for reliably supporting a tubular string with a desired stretch in the string.

SUMMARY OF THE INVENTION

In a preferred embodiment, the wellhead of the present invention is provided with a plurality of axially spaced landing or support grooves which are used for securing the tubular hanger to the wellhead. A support ring on the casing hanger may be moved radially outward for engagement with one of the grooves in response to increased fluid pressure. Lowering of the tubular hanger on the wellhead then prevents the support ring from moving radially inward and reliably supports the casing hanger from the wellhead. A lock ring when engaged in one of the lock grooves prevents the tubular hanger from moving axially upward relative to the wellhead.

It is therefore the primary object of this invention to provide improved wellhead which enables the hanger, such as a casing hanger, to be landed and sealed within the casing head, with a desired tension in the casing, by allowing substantial variations in the space-out length and thus the desired stretch of the casing supported on the casing hanger secured to the wellhead. More particularly, the hanger may pass below the landing or support grooves, and below a lockout groove as discussed below, then the hanger pulled upward to put tension in the tubular string. When at or slightly above a desired tubular tension, the hanger may then be reliably secured to the wellhead.

It is a feature of the present invention to provide a wellhead and hanger wherein the tubular may be continuous between the member which fixes the lower end of the tubular in a well, such as the tie back tool at the mud line, and the hanger at the upper end of the tubular string, without the use of sliding seals used in prior art systems.

It is a further feature of the invention to intersperse a primary and a backup seal above and below one of the grooves on the wellhead to minimize the stack up length required in the wellhead, while still providing the necessary adjustment to obtain the desired stretch of the tubular string. Also, some of the grooves may serve as either a support groove or a lock-out groove.

It is an advantage of the present invention that the casing hanger may be run into the wellhead using a clutch-type running tool.

These and further objects, features, and advantages of the present invention will become apparent from the following detailed description, wherein reference is made to the figures in the accompanying drawings.

DETAILED DESCRIPTION OF PREFERRED EMBODIMENTS

Figure 1:
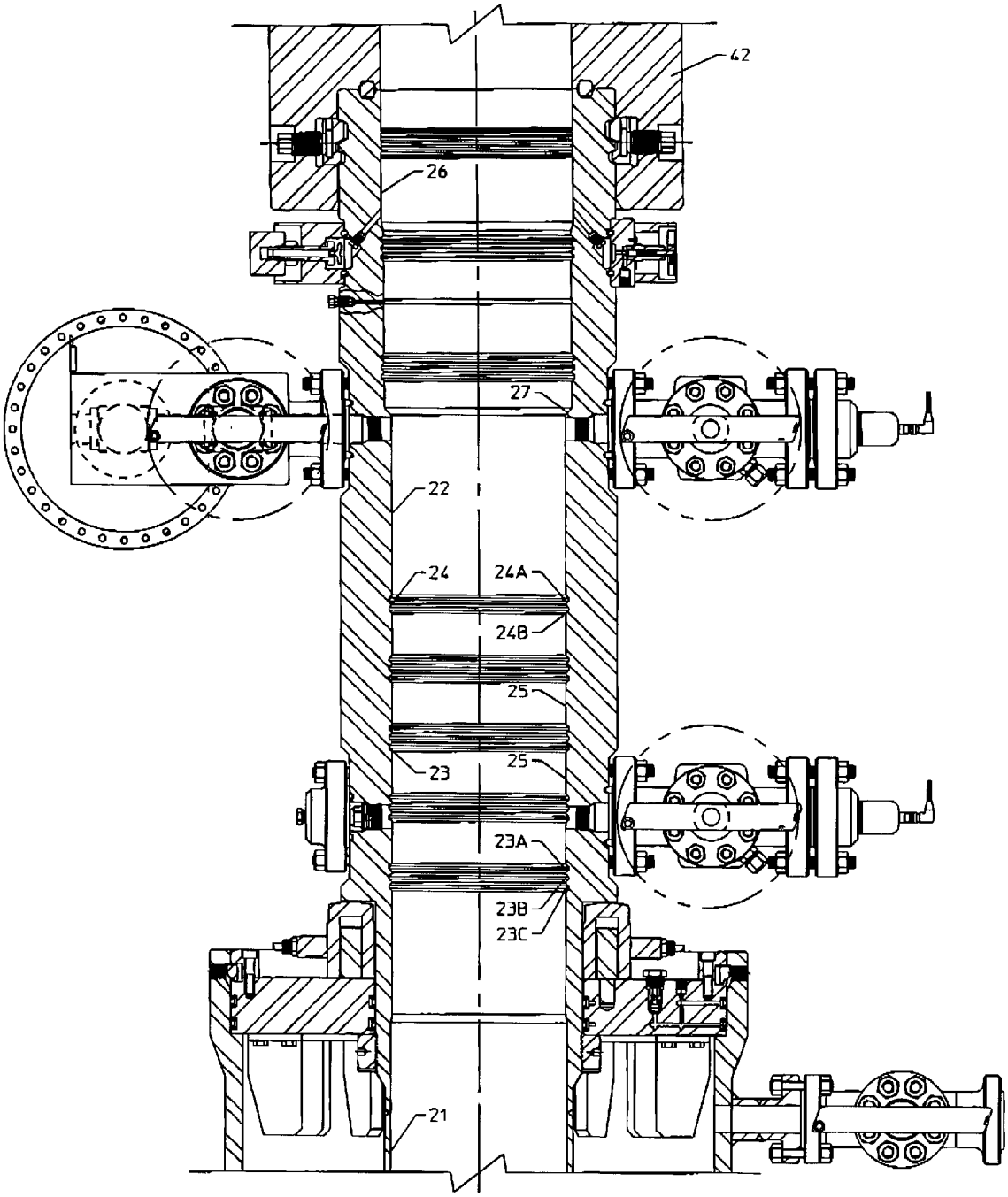
FIG. 1 is a side view of a wellhead according to the present invention prior to receiving a production casing thereon.
Figure 5:
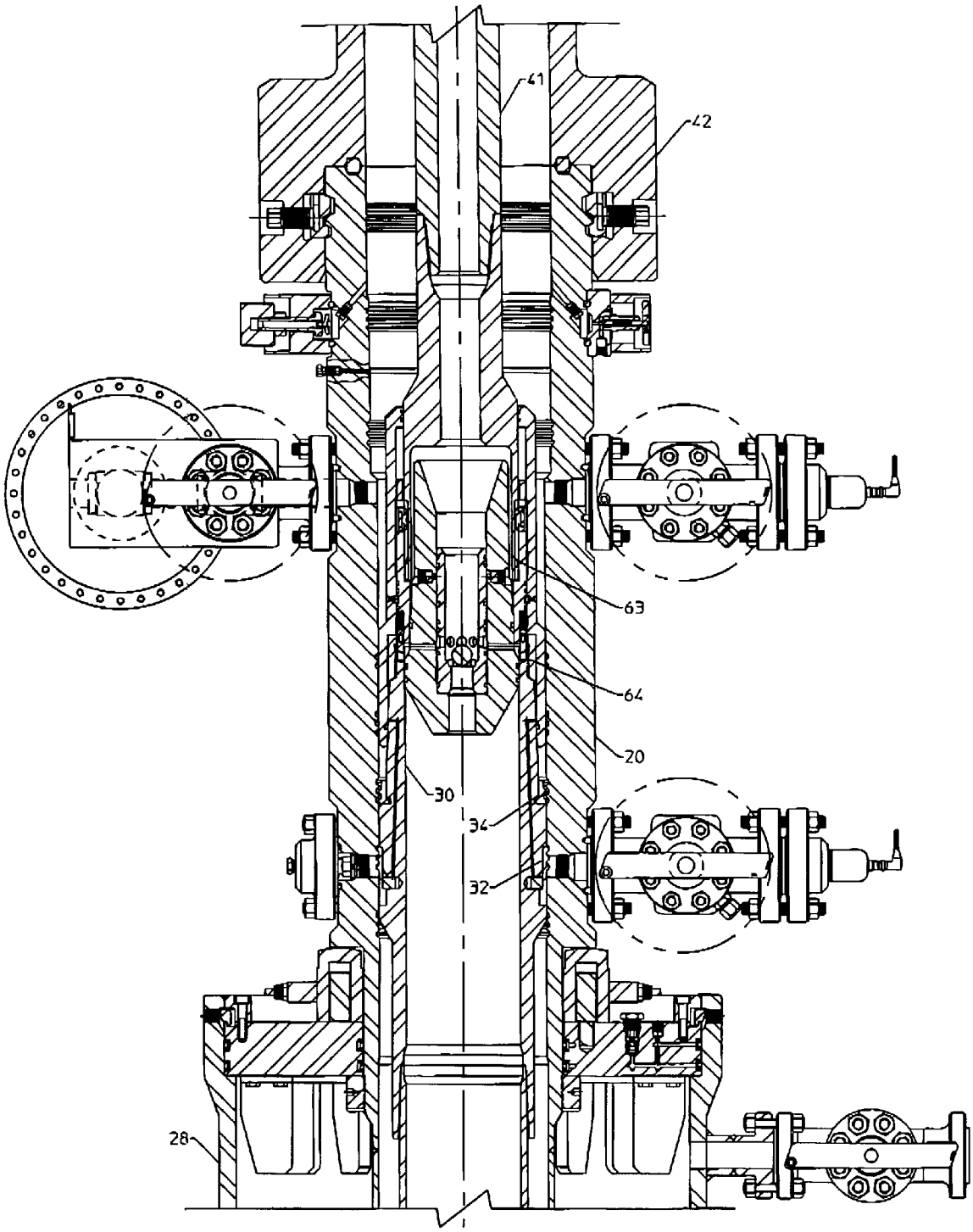
FIG. 5 similarly illustrates downward movement of the work string to allow unthreading of the running tool components from the casing hanger.
Figure 6:
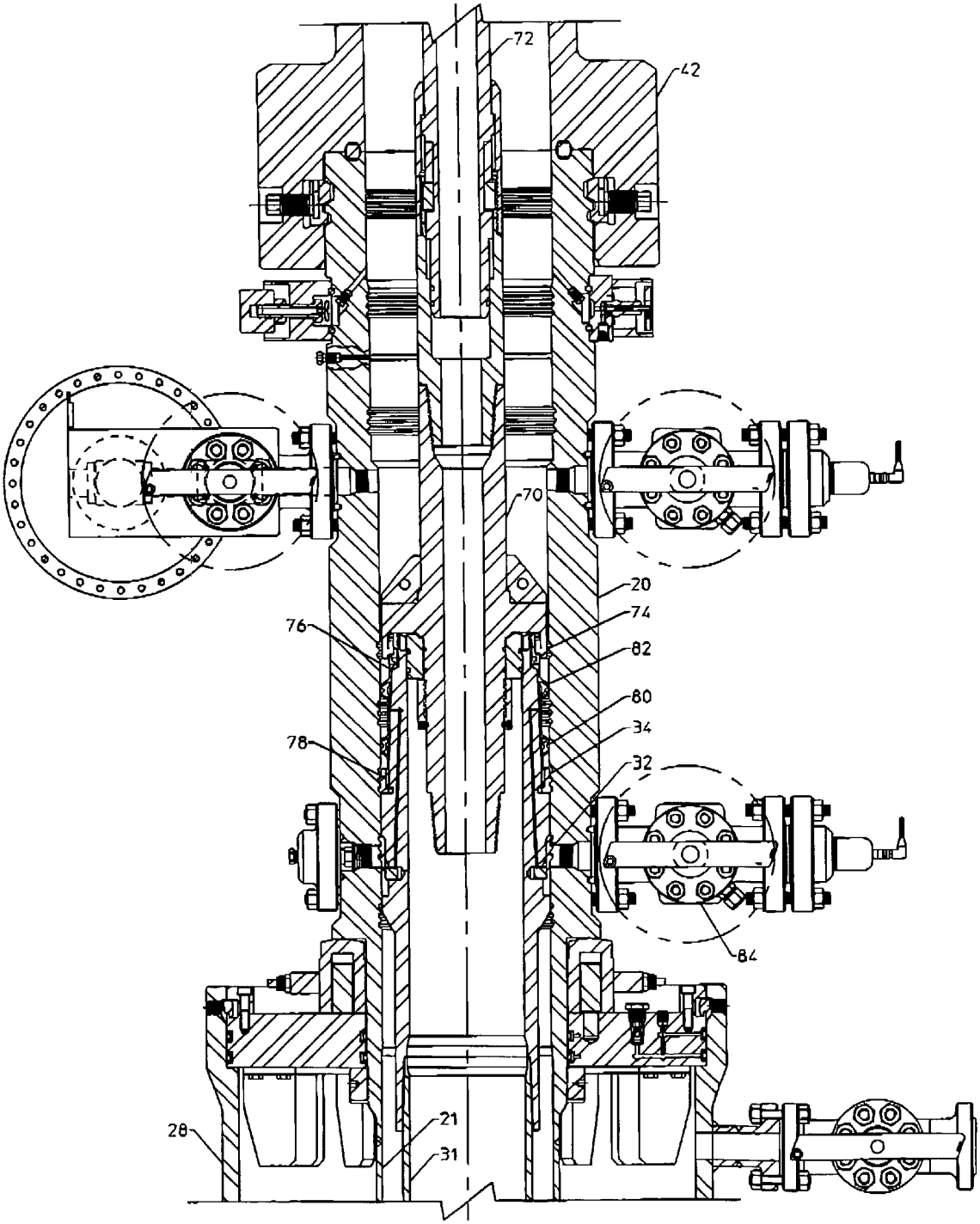
FIG. 6 similarly illustrates the removal of the running tool and the subsequent insertion of a tool to engage a lockdown ring with the wellhead housing, and to seal the casing hanger to the wellhead.

FIG. 1 illustrates a surface wellhead housing 20 at the upper end of an outer casing 21 extending downward to a subsurface wellhead (not shown). The housing bore 22 has a plurality of axially spaced support grooves 23 each adapted to receive a support ring of a casing hanger, as will be described, and one or more lockdown grooves 23 or 24 above the support groove for optionally receiving a lockdown ring on the hanger. The support grooves are preferably equally spaced from one another, and the lockdown groove (s) 23 or 24 are preferably spaced axially the same distance above the uppermost support grooves, thereby forming cylindrical seal surfaces 25 of substantially equal height between adjacent grooves. The housing 20 has an enlarged bore 26 above bore 22 to receive a tubing hanger to be lowered into the housing for landing on a shoulder 27. Conventional load sensors may be used to provide an output for the operator to indicate the weight of casing "hung off" from the wellhead housing 20. As shown in FIGS. 5–6, the outer casing 21 and the production casing 31 each extend downward into the outer conductor 28.

As illustrated, each of the support grooves 23 has three annular groove segments, 23A, 23B, 23C, each extending radially outwardly from the bore. The topmost lockdown groove 24 has only two groove segments 24A and 24B, thus permitting it to receive only the lockdown ring on the tubing hanger, and not a support ring. Depending on the level at which the hanger is to be supported, the lockdown ring may be received in one of the axially spaced support grooves other than the lowermost support groove, as discussed below.

Figure 2:
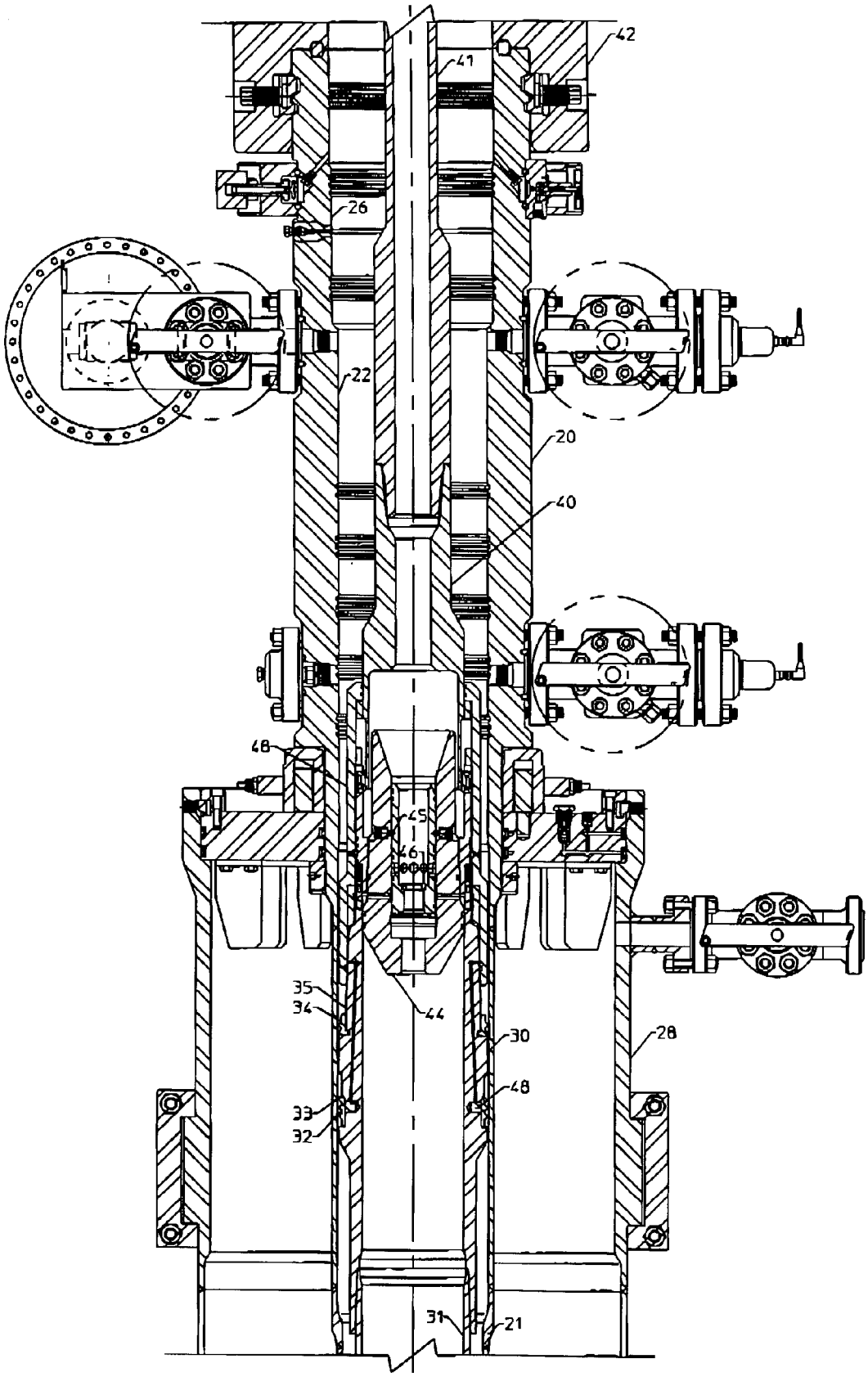
FIG. 2 illustrates the wellhead as shown in FIG. 1, with a casing hanger suspended within the wellhead from a drill pipe, and production casing extending downward to the mud line for interconnection with the tie back at the upper end of a subsurface casing hanger.

As shown in FIG. 2, a casing hanger 30, from which the production casing 31 is suspended, carries the support ring 32 in a recess 33, and carries a lockdown ring 34 about a reduced diameter portion 35. The support ring has three ribs each for engaging one of the three segments of a selected support groove 23, and the lockdown ring 34 has two ribs for locking either within the lockdown groove 24 above the support grooves, or within one of the support grooves above the support groove which receives the support ring 32.

As will be described below, an annular seal mechanism may be lowered onto the landed casing hanger for sealably engaging the seal surface both beneath and above the lockdown ring so as to close the annulus between the casing hanger and the bore of the wellhead housing.

Figure 3:
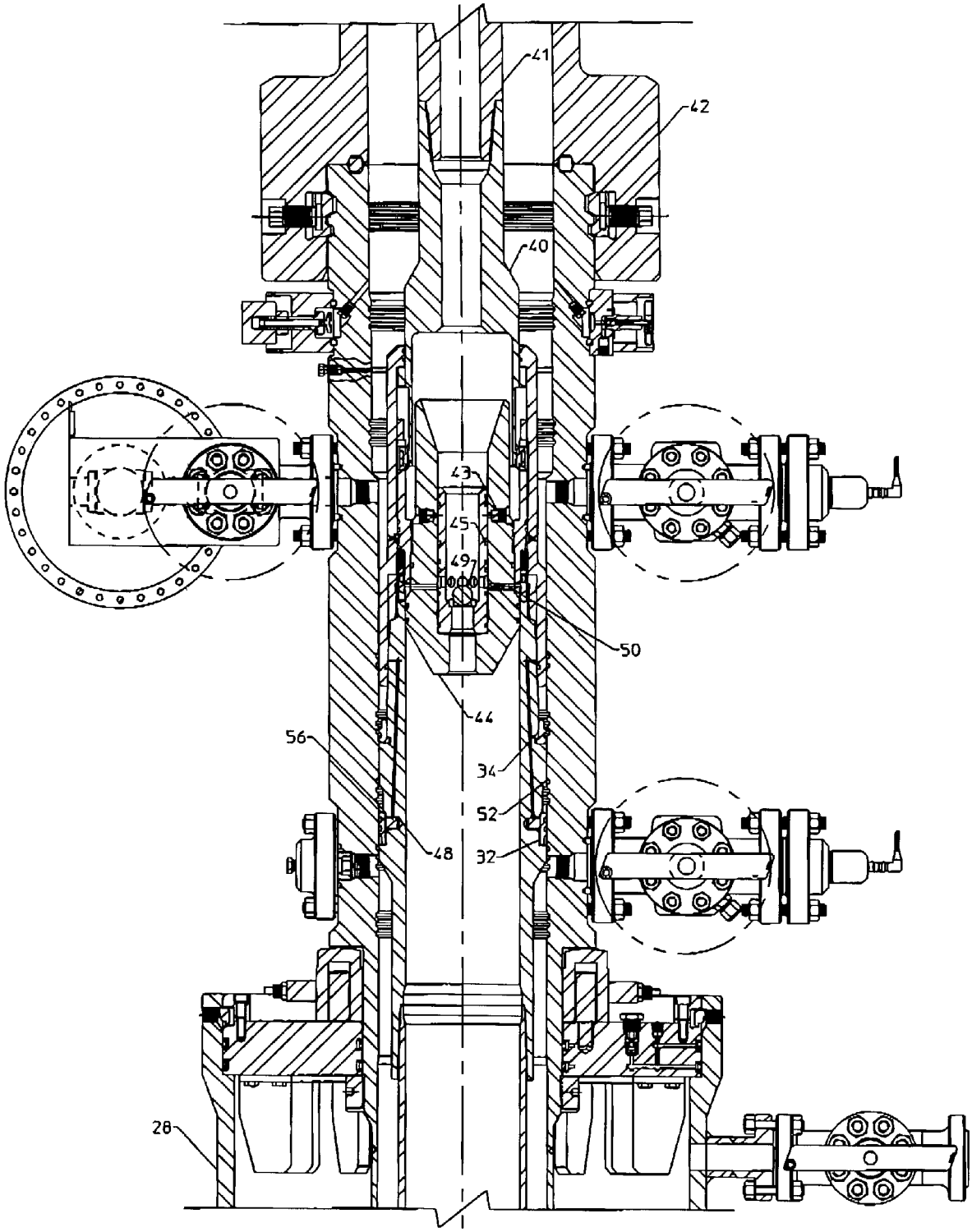
FIG. 3 similarly illustrates the casing hanger with a selected tension applied to the production casing by the operator, and subsequent to dropping a ball to actuate the piston to bias a support ring outward.

As shown in FIGS. 2 and 3, the casing hanger 30 is lowered on a running tool 40 by drill pipe or other work string 41 through a blowout preventer or BOP 42, which is connected above the wellhead housing 20. The BOP preferably has a bore aligned with and sized with bore 26. As shown in FIG. 3, the drill pipe 41 has been raised to pull a desired tension in the production casing 31 which raises the support ring 32 and the lockdown ring 34 to a desired elevation with respect to the wellhead 20 for imparting tension to the casing. The normally retracted support ring 32 is then in a position axially in line with a sealing surface 25 and between a pair of the support grooves, e.g., between the second and third lowermost support grooves as shown in FIG. 3. Since both the support ring 32 and the lockdown ring 34 are normally retracted, they do not engage either the lockdown or the support grooves during this raising of the casing hanger.

Figure 4:
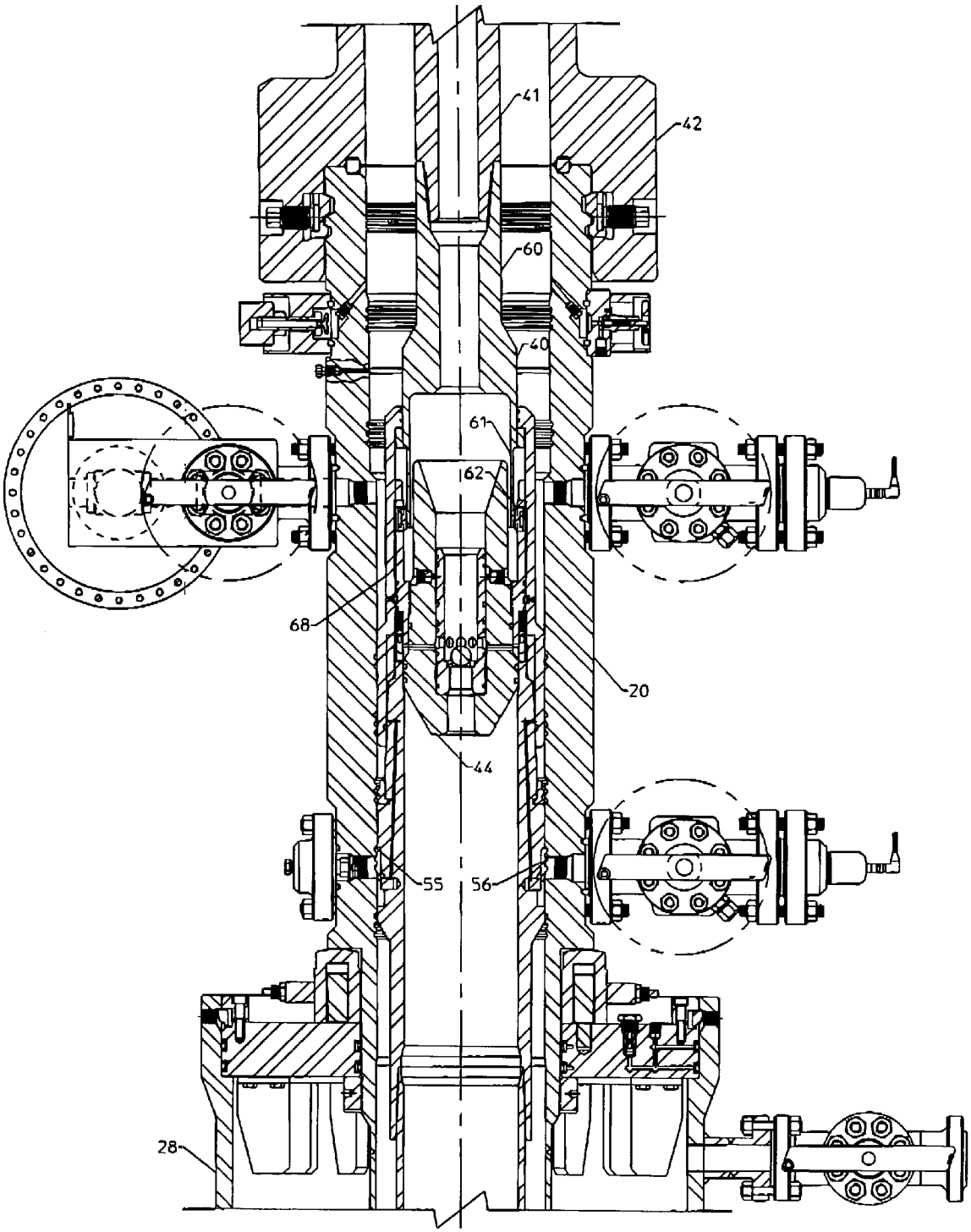
FIG. 4 similarly illustrates the casing hanger after the operator has slacked off slightly so that the hanger moves downward to lock the support ring to the wellhead housing.

Once the hanger 30 is positioned above the groove 23 in which the support ring 32 is to be engaged, one or more circumferentially spaced pistons 48 are urged outwardly to urge the support ring to an outer position for engaging the intended support groove 32. To energize the pistons 48, a ball 49 may be dropped through the drill pipe 41 to land on the seat 46, as shown in FIG. 3. The increase in fluid pressure within the running tool 40 thus shears the pin 43 which holds the sleeve 45 in its upper position, as shown in FIG. 2, and causes the inner sleeve 45 to move to the position as shown in FIG. 3, so that ports 50 in the body 44 are open to fluid pressure within the drill pipe 41, and transmit pressure through the fluid passageways 52 to each of the pistons 48. A series of ports in sleeve 45 allow communication with passageways 52 in a casing hanger 30 to act on pistons 48. The pistons 48 are thus biased radially outward by fluid pressure applied to the radially interior end of each piston. While maintaining the increased fluid pressure within the drill pipe, the operator may slack off slightly so that the support ring 32, which is biased out by the pistons, snaps into the next lower groove 23. The casing hanger may then continue to be lowered until a shoulder 55 lands on the upper end of the outwardly disposed support ring 32. Once the support ring 32 is positioned as shown in FIG. 4, the exterior cylindrical stop surface 56 on the casing hanger prevents the support ring 32 from moving radially inward, and casing weight is reliably hung off from the wellhead housing with the desired tension in the production casing as determined by the operator. From a review of FIGS. 1–3, those skilled in the art will appreciate that the operator may pull upward on a casing string to briefly exert the tension in the casing string slightly above the level desired, so that when the operator slacks off and the ring 32 snaps within the annular recess 23 below that position, the casing string will have the desired stretch.

In many applications, three or more support grooves are provided, with each support groove being spaced axially from other support grooves by a cylindrical sealing surface 25. For many applications, adjacent support grooves will be spaced axially three inches or more apart, since the operator can accommodate a final position of the casing hanger relative to the wellhead housing within a spacing of several inches or more.

Both the support ring 32 and a lockdown ring 34 are preferably split or C-shaped rings, with an outer surface configured for mating with corresponding grooves in the wellhead housing 20. Various mating configurations between the C-rings and the grooves in the wellhead housing are thus possible.

Figure 7:
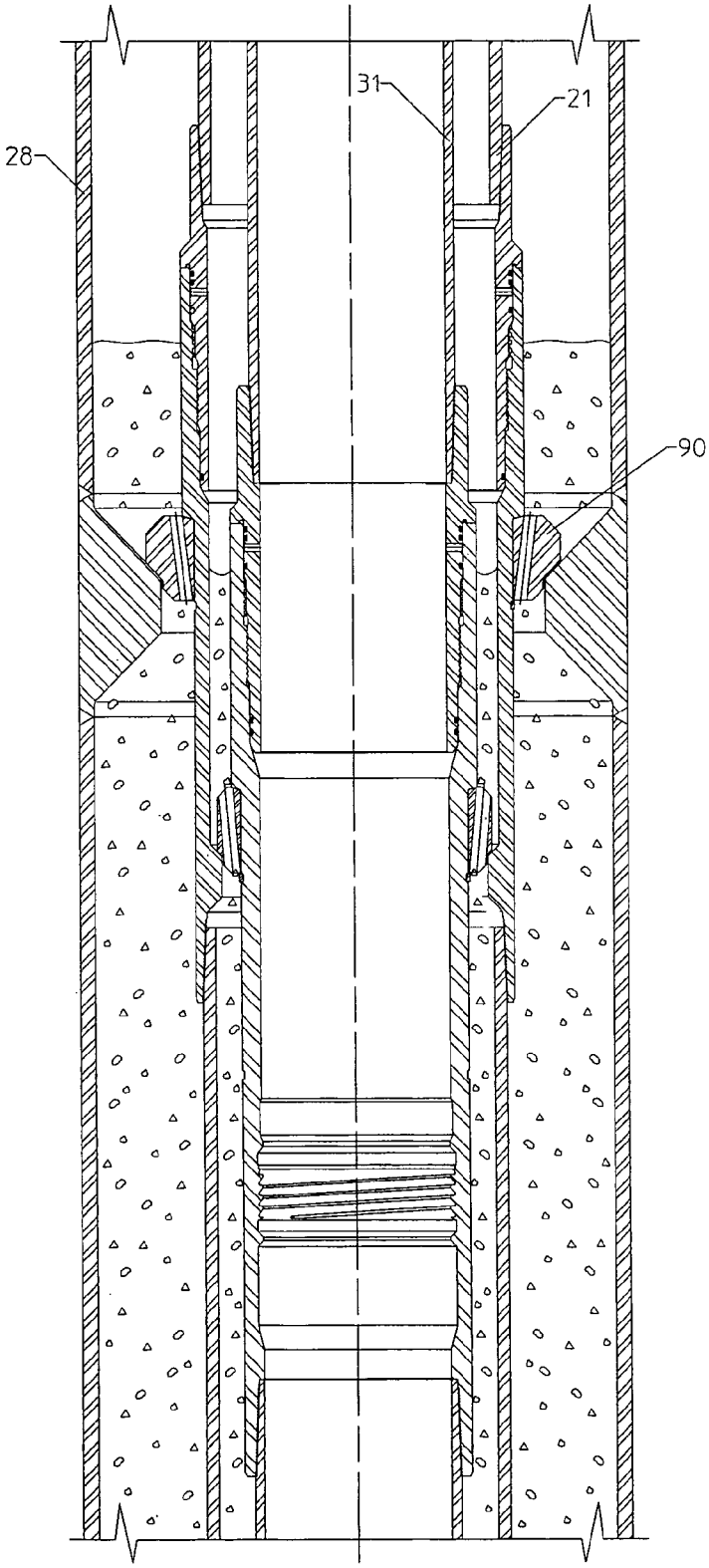

As shown in FIGS. 3, 4, and 5, the running tool 40 comprises an upper tubular body 60 threaded to the lower end of the drill pipe 41. A clutch-type running tool as disclosed in U.S. Pat. No. 5,226,493 allows the production casing or the tubular to be manipulated so that it may be connected at its lower end to a mud liner hanger, or otherwise secured, e.g., by an anchor, within the well. FIG. 7 simplistically depicts in mud liner hanger 90 at the lower end of tubular 31 for securing the lower end of the tubular with the well. Outer sleeve 68 may move axially with respect to inner body 44, which in turn carries an inner sleeve 45 with the landing seat 46. When the running tool 40 is positioned as shown in FIG. 4, the splines on the lower sleeve 61 of body 60 engage corresponding splines 62, so that the inner body 44 as well as the casing hanger 30 and the casing supported therefrom may be rotated to make up at the level of the mud line. Rotation of the casing string 31 also may be used to close off ports in the mud liner hanger. After the mud line connection is made up and the support ring 32 has moved to the position as shown in FIG. 4, the operator may set weight down on the drill pipe 41 to disengage the splines 62 and engage the lower splines 63 on the body 44, as shown in FIG. 5. When in the position as shown in FIG. 5, torque may then be applied to the drill pipe to unthread the running tool 40 from the threads 64 at the upper end of the casing hanger 30, so that the drill pipe may be raised for removing the running tool 40 from within the wellhead housing.

Once the running tool has been removed, a seal element and locking tool 70 as shown in FIG. 6 may be run in the wellhead at the lower end of work tubular 72. The tool 70 includes a conventional J-lock mechanism 74 for carrying seal element 76 into the bore in the wellhead housing. The lower end of the seal element 76 includes a nose 78 which presses the lockdown ring 34 radially outward into either the lockdown ring groove 24 or into the support ring groove above the groove occupied by the support ring 32. The sealing element 76 preferably includes at least two axially spaced elastomeric and metal rib sealing bodies 80 and 82 which are connected by a common seal element base. The seal bodies 80 and 82 are spaced above and below one of the grooves, so that each seal body 80 and 82 forms a reliable seal with the inner cylindrical surface 25 of the wellhead housing. By manipulation of the tool 70, the body of the tool may be released from the seal element with the J-lock mechanism, and the tool 70 then pulled out of the wellhead 20.

It should be noted that the gate valve 84 as shown in FIG. 6 will conventionally be positioned below the seal element 76, and allows communication to the annulus between the production casing 31 and the outer casing 21. The production casing 31 may typically connect to a mud line tie back connector on a casing hanger, while the outer casing 21 typically connects to a subsea housing. Also, it should be appreciated that the port of the wellhead body in communication with the gate valve 41 is shown at the same elevation as in one of the support grooves 23. This does not decrease the reliability of these components to perform their desired function, since the grooves are preferably provided circumferentially around the full bore of the wellhead body, and the C-shaped support ring 32 and the lockdown ring 34 have sufficient strength to perform their desired functions even if the annular groove is briefly interrupted by a port. The support ring 32 may thus prevent casing from moving downward with respect to the wellhead housing 20 and thus supports the production casing 31. The lockdown ring 32 prevents any upward movement of the casing with respect to housing 20, which may occur if there were a pressure surge.

The seal element 76 is thus moved axially into position for performing its function after the casing hanger 30 has been supported in a selected one of the various possible vertical positions with respect to the wellhead. Once the seal element 76 is positioned as shown in FIG. 6, the seal element is a static seal which preferably seals with two of the cylindrical surfaces 25 (see FIG. 1) between the support grooves or lockdown groove. By interspersing the seal above and below these groove profiles, the length required for the wellhead stack up is reduced. Locking groove 24 is configured differently than groove 23 to insure that the support ring 32 cannot snap into the groove 24, since then no groove would be provided for a lock ring 34. Regardless of which axially spaced groove the operator decides to engage with the support ring 32, the lockdown ring 34 is spaced above the support ring and fits within the next upper groove 23 or 24 above the groove 23 which receives the support ring 32.

The wellhead of the present invention thus provides a high degree of flexibility to adjust the casing hanger relative to the wellhead, thereby allowing for a desired stretch in the casing. This increased flexibility is a significant feature of the present invention, since the support surfaces and the lockdown surfaces on the wellhead may be provided radially inward of the central bore in the wellhead. The casing hanger may thus be lowered below and, if desired, a substantial distance below, the support surfaces. When in its desired position, the casing hanger and the casing secured thereto may be pulled upward into the bore of the wellhead and, when a desired tension is obtained in the casing, the hanger may then be supported on the support surfaces of the wellhead, as discussed above. If the casing hanger is not at a desired position relative to the wellhead when desired tension is applied in the casing string, the operator need not hang off the casing string from the wellhead, but instead may elect to reposition the casing hanger at either a higher or lower position relative to the casing string such that, when the casing hanger is subsequently raised to its desired position within the wellhead, the desired tension will be applied to the casing string and the hanger may thus be hung off from the wellhead assembly with the desired tension in the string.

The operator may thus apply tension to the casing hanger to cause the casing to stretch, then increase fluid pressure within the work string by dropping a ball, so that when the operator slacks off slightly, the support ring snaps into the next lowest groove. The application of fluid pressure through the work string along with the downward motion of the casing hanger activates the support ring to support the casing string from the wellhead. A lockdown ring subsequently insures that the casing string cannot move upward relative to the wellhead. A support groove may also serve as a lockdown groove. The seal surfaces are preferably spaced between the grooves to minimize the stack up height of the wellhead assembly.

The wellhead as shown in the enclosed drawings is a "two step" wellhead with a lower bore 22 for receiving a casing hanger, and an upper bore 26 for receiving a tubing hanger. The present invention may be used in a wellhead which only supports a casing hanger, and a separate upper wellhead may support the tubing hanger, or tubing may not yet be provided within the well.

While hydraulic fluid pressure is preferably used for biasing the pistons and thus the support ring radially outward, other techniques may be used for biasing a support ring in the radially outward position so that, once the support ring engages its intended groove in the wellhead housing, the hanger may be lowered to effectively lock the support ring in its radially outward position, thereby supporting the hanger and the tubular supported on the hanger from the wellhead housing. Also, while a C shaped support ring and lock ring are preferred to obtain high reliability with very little vertical spacing, other mechanisms may be used for interconnecting the hanger and the housing in a selected axial position once the desired stretch in the tubular has been obtained. A significant feature of this invention is the ability of the hanger to pass through the wellhead unhindered to allow the tie back to the subsea structure.

The techniques of the present invention are particularly well suited for obtaining the desired stretch in a casing string fixed to a subsea wellhead near the mud line. The present invention provides a wellhead with an interior surface adapted to lock with the casing string at one of a selected plurality of elevations. Various types of oilfield tubulars, including a production casing or a riser, may be supported from the hanger secured to the wellhead by the techniques disclosed herein.

It will be understood by those skilled in the art that the embodiment shown and described is exemplary and various other modifications may be made in the practice of the invention. Accordingly, the scope of the invention should be understood to include such modifications which are within the spirit of the invention.

What is claimed is:

1. An adjustable hanger system for connecting a hanger to a wellhead, the hanger system comprising:

the hanger suspending a tubular secured at its lower end in the well;

the wellhead including a housing having a plurality of axially spaced support grooves, each groove having a profile to receive a support ring therein; and the hanger axially moveable through the wellhead and relative to the support grooves, the hanger supporting the support ring radially moveable into a selected one of the plurality of support grooves in the wellhead housing to interconnect the hanger to the wellhead.

2. An adjustable hanger system as defined in claim 1, further comprising:

the wellhead including a lock down groove separate from the plurality of support grooves; and a lock down ring for securing the hanger to the wellhead by preventing axially upward movement of the hanger relative to the wellhead.

3. An adjustable hanger system as defined in claim 2, wherein the support ring is carried in a retracted position within a recess in the hanger prior to the support ring moving radially outward into the selected one of a plurality of support grooves.

4. An adjustable hanger system as defined in claim 2, wherein the lock down ring is carried in a retracted position within a recess in the hanger prior to the lock down ring moving radially outward into the lock down groove.

5. An adjustable hanger system as defined in claim 1, wherein the support ring comprises three or more axially spaced circumferential ribs each for engagement with a selected one of the plurality of support grooves.

6. An adjustable hanger system as defined in claim 5, wherein a lock down ring comprises two or more axially spaced circumferential ribs each for moving radially outward into the lock down groove.

7. An adjustable hanger system as defined in claim 1, wherein the support ring is biased radially inward.

8. An adjustable hanger system as defined in claim 2, wherein the lock down ring is biased radially inward.

9. An adjustable hanger system as defined in claim 2, wherein each of the plurality of support grooves has a profile for receiving the support ring, and the lock down groove has a profile for rejecting the support ring.

10. An adjustable hanger system as defined in claim 1, wherein the support ring is radially moveable in response to a fluid pressure member.

11. An adjustable hanger system as defined in claim 10, wherein the fluid pressure responsive member comprises a plurality of circumferentially spaced pistons.

12. An adjustable hanger system as defined in claim 10, wherein the support ring moves radially inward in response to increased fluid pressure in an annulus surrounding the hanger.

13. An adjustable hanger system as defined in claim 1, wherein an exterior stop surface on the hanger prevents the support ring from moving radially inward while in its selected support groove.

14. An adjustable hanger system as defined in claim 13, wherein the exterior stop surface moves axially with respect to the support ring to a locked position radially inward at its selected support groove.

15. An adjustable hanger system as defined in claim 2, wherein the selected one of the plurality of support grooves is positioned axially below the lock down groove.

16. An adjustable hanger system as defined in claim 1, wherein the support ring is a substantially C-shaped unitary member.

17. An adjustable hanger system as defined in claim 2, wherein the lock down ring is a substantially C-shaped unitary member.

18. An adjustable hanger system as defined in claim 1, wherein the wellhead housing includes a seal surface for sealing with a sealing mechanism acting between the hanger and the wellhead.

19. An adjustable hanger system as defined in claim 18, further comprising:

a plurality of substantially cylindrical sealing surfaces on the wellhead housing, each of the sealing surfaces being spaced between an upper and a lower one of the plurality of support grooves for sealing engagement with the sealing mechanism.

20. An adjustable hanger system as defined in claim 19, further comprising:

at least one lock down groove spaced above the plurality of support grooves for securing the hanger to the wellhead; and a second sealing surface on the wellhead housing is located between the at least one lock down groove and one of the plurality of support grooves having an axial spacing substantially equal to an axially spacing of the sealing surfaces between the upper and a lower support groove.

21. An adjustable hanger system as defined in claim 18, further comprising:

the wellhead including a lock down groove separate from the plurality of support grooves; and a lock down ring for securing the hanger to the wellhead by preventing axially upward movement of the hanger relative to the wellhead.

22. An adjustable hanger system as defined in claim 1, wherein a shoulder on the hanger lands on the support ring to prevent axially downward movement of the hanger and the tubular with respect to the support ring fixed to the wellhead housing.

23. An adjustable hanger system as defined in claim 1, wherein the lower end of the tubular is secured to the well by a lower hanger.

24. An adjustable hanger system as defined in claim 1, wherein a bore in the wellhead housing includes a radially enlarged upper portion for receiving a tubing hanger.

25. An adjustable hanger system as defined in claim 24, wherein the wellhead housing includes an upper shoulder for supporting the tubing hanger above the hanger secured to the wellhead by the support ring.

26. An adjustable hanger system as defined in claim 1, further comprising:

a BOP above the wellhead, the BOP having a bore diameter substantially equal to the bore diameter of an upper portion of the wellhead housing.

27. A method of adjustably connecting a hanger to a wellhead, the method comprising:

suspending a tubular from a hanger, the tubular secured at its lower end in the well;

providing a wellhead housing having a plurality of axially spaced support grooves each having a profile to accept a support ring;

providing the hanger including the radially moveable support ring; lifting the hanger and the support ring above a selected one of the plurality of support grooves; and thereafter lowering the hanger such that the support ring moves radially outward into the selected one of the plurality of support grooves, thereby preventing axially downward movement of the hanger with respect to the wellhead.

28. A method as defined in claim 27, further comprising:

increasing fluid pressure in the well to move the support ring radially outward into the selected one of the plurality of support grooves.

29. A method as defined in claim 27, further comprising:

lowering the hanger axially to move a stop surface on the hanger radially inward of the radially expanded support ring, thereby preventing the support ring from moving out of the selected one of the plurality of support grooves.

30. A method as defined in claim 27, further comprising:

providing a lock down ring on the hanger;

providing at least one lock down groove on the wellhead housing; and positioning the lock down ring in the lock down groove to lock the tubing hanger to the wellhead, the lock down ring preventing axially upward movement of the hanger with respect to the wellhead.

31. A method as defined in claim 27, further comprising:

lowering at least a portion of the hanger below the plurality of support grooves;

thereafter moving the hanger upward to provide a desired tension in the tubular; and thereafter locking the support ring to the selected one of the plurality of support grooves.

32. A method as defined in claim 27, further comprising:

landing a tubing hanger on a shoulder of the housing to support the tubing hanger in the well.

33. A method as defined in claim 27, further comprising:

increasing pressure in the well to axially move a sleeve, thereby exposing ports to fluid pressure to move the support ring to its expanded position into the selected one of the plurality of support grooves.

34. A method as defined in claim 33, further comprising:

shearing a pin supporting the sleeve, such that upon shearing the pin the sleeve moves to open the ports.

35. A method as defined in claim 27, further comprising:

providing a plurality of fluid pressure responsive pistons from moving the support ring to its expanded position into the selected one of the plurality of support grooves.

36. A method as defined in claim 27, further comprising:

providing a plurality of sealing surfaces on the wellhead housing, each of the plurality of sealing surfaces being spaced between an upper and lower one of the plurality of support grooves.

37. A method as defined in claim 27, further comprising:

lowering a seal element on a running tool into the well after the support ring has expanded outward into the selected one of the plurality of support grooves; and axially moving the seal element relative to the hanger and the wellhead to set the seal between the hanger and the wellhead.

38. A method as defined in claim 37, wherein the seal element is run in the well with a lock down ring actuator for moving the lock down ring into the lock down groove.

39. A method as defined in claim 27, further comprising:

utilizing a clutch-type running tool to run the tubular into the well and secure the lower end of the tubular in the well.

40. A method as defined in claim 27, further comprising:

slacking off on a running string to lower the support ring into the selected one of the plurality of grooves.

41. A method as defined in claim 27, further comprising:

securing a lower end of the tubular string in the well by a lower hanger.

42. A method as defined in claim 41, further comprising:

providing a running tool having a first set of splines allowing axial manipulation with secured rotation between a running string and the tubular to secure the lower end of the tubular in the well; and providing a second set of splines on the running tool allowing axial manipulation and secured rotation between the running string and the hanger for disconnecting the running tool from the hanger after the support ring has moved into the select one of the plurality of support grooves.

* * * * *